US008343703B2

(12) United States Patent
Maehata et al.

(10) Patent No.: US 8,343,703 B2
(45) Date of Patent: Jan. 1, 2013

(54) ELECTROSTATIC IMAGE DEVELOPING TONER, METHOD FOR MANUFACTURING ELECTROSTATIC IMAGE DEVELOPING TONER, ELECTROSTATIC IMAGE DEVELOPER, TONER CARTRIDGE, PROCESS CARTRIDGE, IMAGE-FORMING METHOD AND IMAGE-FORMING APPARATUS

(75) Inventors: Hideo Maehata, Kanagawa (JP); Yasuo Matsumura, Kanagawa (JP); Takashi Imai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 637 days.

(21) Appl. No.: 12/537,625

(22) Filed: Aug. 7, 2009

(65) Prior Publication Data

US 2010/0233604 A1 Sep. 16, 2010

(30) Foreign Application Priority Data

Mar. 10, 2009 (JP) ..... 2009-056289

(51) Int. Cl.
*G03G 9/087* (2006.01)

(52) U.S. Cl. ..... 430/109.4; 430/111.4; 430/137.14; 430/137.15; 430/123.52

(58) Field of Classification Search ..... 430/109.4, 430/111.41, 111.4, 137.14, 137.15
See application file for complete search history.

(56) References Cited

U.S. PATENT DOCUMENTS

| | | | | |
|---|---|---|---|---|
| 3,967,962 | A * | 7/1976 | O'Malley | 430/109.4 |
| 4,528,257 | A * | 7/1985 | Polderman et al. | 430/109.3 |
| 4,940,644 | A * | 7/1990 | Matsubara et al. | 430/109.4 |
| 5,229,242 | A | 7/1993 | Mahabadi et al. | |
| 5,364,724 | A | 11/1994 | Mahabadi et al. | |
| 5,981,128 | A * | 11/1999 | Tavernier et al. | 430/109.2 |
| 6,033,819 | A | 3/2000 | Matsui et al. | |
| 6,042,983 | A * | 3/2000 | Tavernier et al. | 430/109.4 |
| 6,632,883 | B2 | 10/2003 | Mayes et al. | |
| 7,538,157 | B2 | 5/2009 | Mayes et al. | |
| 7,575,841 | B2 * | 8/2009 | Daimon et al. | 430/109.4 |
| 2003/0039913 | A1 * | 2/2003 | Kadokura et al. | 430/110.4 |
| 2004/0132920 | A1 * | 7/2004 | Matsumura et al. | 430/109.4 |
| 2004/0137350 | A1 * | 7/2004 | Yamazaki et al. | 430/109.4 |
| 2004/0137354 | A1 * | 7/2004 | Yamazaki et al. | 430/109.4 |
| 2007/0073000 | A1 | 3/2007 | Mayes et al. | |
| 2007/0092823 | A1 | 4/2007 | Matsumura et al. | |
| 2011/0065039 | A1 * | 3/2011 | Ota et al. | 430/109.3 |

FOREIGN PATENT DOCUMENTS

| | | | |
|---|---|---|---|
| GB | 1414159 | A * | 10/1973 |
| GB | 1 431 699 | | 4/1976 |
| JP | A 49-17739 | | 2/1974 |
| JP | A 57-201246 | | 12/1982 |
| JP | A 58-086557 | | 5/1983 |
| JP | A 61-056355 | | 3/1986 |
| JP | A 05-188636 | | 7/1993 |
| JP | A 06-019182 | | 1/1994 |
| JP | A 08-095294 | | 4/1996 |
| JP | A 2005-027523 | | 2/2005 |
| JP | A 2006-516299 | | 6/2006 |
| JP | A 2007-034280 | | 2/2007 |
| JP | A 2007-114635 | | 5/2007 |

OTHER PUBLICATIONS

Diamond, Arthur S & David Weiss (eds.) Handbook of Imaging Materials, 2nd ed.. New York: Marcel-Dekker, Inc. (Nov. 2001) pp. 209-220.*

* cited by examiner

*Primary Examiner* — Christopher Rodee
(74) *Attorney, Agent, or Firm* — Oliff & Berridge, PLC

(57) ABSTRACT

An electrostatic image developing toner, includes: a block copolymer that contains: a block A that has a glass transition temperature of about 60° C. or more; and a crystalline block B that has a melting point of about 25° C. or more derived from an ethylenically unsaturated compound, wherein the block copolymer satisfies the following equations (1) to (3):

$$30° \text{ C.} \leqq [T(0.5 \text{ MPa}) - T(30 \text{ MPa})] \leqq 80° \text{ C.} \quad (1)$$

$$60° \text{ C.} \leqq T(0.5 \text{ MPa}) \quad (2)$$

$$T(30 \text{ MPa}) \leqq 80° \text{ C.} \quad (3)$$

wherein T(0.5 MPa) represents a temperature at which a viscosity of the block copolymer is $10^4$ Pa·s when a pressure applied by a flow tester is 0.5 MPa; and T(30 MPa) represents a temperature at which a viscosity of the block copolymer is $10^4$ Pa·s when a pressure applied by a flow tester is 30 MPa.

18 Claims, No Drawings

ELECTROSTATIC IMAGE DEVELOPING TONER, METHOD FOR MANUFACTURING ELECTROSTATIC IMAGE DEVELOPING TONER, ELECTROSTATIC IMAGE DEVELOPER, TONER CARTRIDGE, PROCESS CARTRIDGE, IMAGE-FORMING METHOD AND IMAGE-FORMING APPARATUS

CROSS-REFERENCE TO RELATED APPLICATION

This application is based on and claims priority under 35 USC 119 from Japanese Patent Application No. 2009-056289 filed Mar. 10, 2009.

BACKGROUND

1. Technical Field

The present invention relates to an electrostatic image developing toner, a method manufacturing for the electrostatic image developing toner, an electrostatic image developer, a toner cartridge, a process cartridge, an image-forming method, and an image-forming process.

2. Related Art

In an electrostatic image developing toner using addition polymerizable resins having a random monomer chain and a polycondensation resin as a binder resin, fixation has been mainly accelerated by heating rather than pressure.

In recent years, in printing and copying techniques by electrophotographic methods, the industry has come to grips with the object of utilizing fixation by pressure (pressure fixing) to shift the course from conventional fixing method primarily by heat energy for the purpose of further energy saving.

SUMMARY

According to an aspect of the invention, there is provided an electrostatic image developing toner, including:

a block copolymer that contains, a block A that has a glass transition temperature of about 60° C. or more; and a crystalline block B that has a melting point of about 25° C. or more derived from an ethylenically unsaturated compound, wherein the block copolymer satisfies the following equations (1) to (3):

$$30° \text{ C.} \leqq [T(0.5 \text{ MPa}) - T(30 \text{ MPa})] \leqq 80° \text{ C.} \quad (1)$$

$$60° \text{ C.} \leqq T(0.5 \text{ MPa}) \quad (2)$$

$$T(30 \text{ MPa}) \leqq 80° \text{ C.} \quad (3)$$

wherein T(0.5 MPa) represents a temperature at which a viscosity of the block copolymer is $10^4$ Pa·s when a pressure applied by a flow tester is 0.5 MPa; and T(30 MPa) represents a temperature at which a viscosity of the block copolymer is $10^4$ Pa·s when a pressure applied by a flow tester is 30 MPa.

DETAILED DESCRIPTION

I. Electrostatic Image Developing Toner

The electrostatic image developing toner of the invention (hereinafter, sometimes referred to as merely "toner", also) contains a block copolymer comprising block A having a glass transition temperature of 60° C. or more, and crystalline block B having a melting point of 25° C. or more derived from an ethylenically unsaturated compound, and the block copolymer satisfies the following equations (1) to (3):

$$30° \text{ C.} \leqq [T(0.5 \text{ MPa}) - T(30 \text{ MPa})] \leqq 80° \text{ C.} \quad (1)$$

$$60° \text{ C.} \leqq T(0.5 \text{ MPa}) \quad (2)$$

$$T(30 \text{ MPa}) \leqq 80° \text{ C.} \quad (3)$$

In formulae (1) to (3), T(0.5 MPa) represents the temperature at which the viscosity of the block copolymer is $10^4$ Pa·s when the pressure applied by a flow tester is 0.5 MPa, and T(30 MPa) represents the temperature at which the viscosity of the block copolymer is $10^4$ Pa·s when the pressure applied by a flow tester is 30 MPa. In the embodiments of the invention, description of the range of a numerical value such as "from A to B" has the same meaning as "A or more and B or less" unless otherwise indicated. The embodiments of the invention will be described in detail below.

The electrostatic image developing toner of the exemplary embodiment consists of block A having a glass transition temperature of 60° C. or more, and crystalline block B having a melting point of 25° C. or more derived from an ethylenically unsaturated compound, which utilizes a phase transition phenomenon by pressure of the block copolymer satisfying equations (1) to (3).

It is known that the polymer chains of a block copolymer consisted of blocks incompatible with each other at room temperature (25° C.) change in structure from an ordered structure such as lamella structure or cylinder structure to a disordered state at a certain boundary temperature. With respect to the temperatures of the state change, a boundary temperature that causes a change from an ordered state to a disordered state when the temperature is changed from a low temperature to high temperature region is called UDOT (Upper Disorder to Order Transition) temperature, and, in contrast with this, a boundary temperature that causes a change from a disordered state to an ordered state is called LDOT (Lower Disorder to Order Transition) temperature.

In the change from an ordered state to a disordered state, it is reported that the melt viscosity of a block copolymer greatly lowers (P. J. Flory et al., J. Am. Chem. Soc., 86, 3515 (1964), L. P. Mcmaster et al., Macromolecules, 6, 760 (1973), I. C. Sanchez et al., Macromolecules, 11, 1145 (1978), C. Yeung et al, Phys. Rev. Lett., 72, 1834 (1994), T. Hino et al., Macromolecules, 31, 2636 (1998), H. Hasegawa et al., J. Phys. Chem. Solids, 60, 1307 (1999)).

It is also reported that the phase transition phenomenon of block copolymers by temperature greatly depends upon pressure (Du. Yeol. Ryu et al., Phys. Rev. Lett., 90, 235501 (2003)). In this case, the pressure dependency in phase transition means a phenomenon that the boundary temperature of phase transition shown above decreases or increases in the state of application of pressure.

The present inventors have earnestly examined with the objects of the applications of lowering of melting viscosities by temperatures of block copolymers and pressure dependency of a phase transition phenomenon to pressure fixation type electrostatic image developing toners. As a result, it has been found that an excellent pressure fixing property has been realized by ordinary temperature or in combination with a small quantity of heat energy by the use of the electrostatic image developing toner of the exemplary embodiment of the invention, and an image having excellent fixing image strength can be obtained without damaging the use environment by volatile organic compounds (VOC).

The exemplary embodiment is the one utilizing the lowering of UDOT temperature by application of pressure, and relating to an electrostatic image developing toner capable of compatibility of excellent fixing ability of a toner on a recording medium (the same meaning as "a transfer-receiving material") by pressure of a fixing member in an image-forming apparatus such as an electrophotographic apparatus, etch, and excellent stability in various electrophotographic processes, e.g., a development process.

The block copolymer contained in the toner of the exemplary embodiment has higher volume resistance than those of conventional block copolymers while maintaining the characteristics such as phase transition by heat and pressure, and lowering of melt viscosity resulting from that of conventional block copolymers. In the application of block copolymer resins to electrophotographic toners, since fixing is conventionally carried out with a proper amount of heat and pressure in fixation to media such as paper and the like, it has been necessary to copolymerize a component having a glass transition temperature of lower than room temperature as at least one main component of the block copolymer. However, when such a component of low glass transition temperature is introduced as the main component constituting a block copolymer, leakage of electric charge of triboelectrification that is important in electrophotographic toners is liable to occur. Accordingly, since the quantity of charge of toner is small at starting time after turning on power supply of the system, or just after starting time after out of operation of the system for a certain period of time (energy saving mode, standby mode), splashing of toner and clouding (a phenomenon that the inside of apparatus is stained with a toner) occur. In the exemplary embodiment of the invention, leakage of electric charge can be inhibited to prevent lowering of the quantity of charge by the high volume resistance of the block copolymer, deterioration of image quality (blur) due to splashing of toner and generation of clouding in the apparatus can be restrained at the time of turning on of power supply and just after out of operation of image-forming apparatus for a short period of time as described above.

1. Block Copolymer

<Block A having a Glass Transition Temperature of 60° C. or More, and Crystalline Block B having a Melting Point of 25° C. or More Derived from an Ethylenically Unsaturated Compound>

In the exemplary embodiment, the block copolymer contains block A having a glass transition temperature of 60° C. or more or about 60° C. or more (hereinafter sometimes referred to as merely "block A"), and crystalline block B having a melting point of 25° C. or more or about 25° C. or more derived from an ethylenically unsaturated compound (hereinafter also referred to as merely "crystalline block B").

The glass transition temperature of block A (hereinafter sometimes referred to as "Tg (A)") is 60° C. or more. When Tg (A) is less than 60° C., the preservation stability of the toner is inferior, and the toner strength in the image-forming apparatus (toner strength in the system) lowers.

Tg (A) is preferably 80 to 150° C. or about 80 to about 150° C., and more preferably 90 to 120° C. or about 90 to about 120° C. When Tg (A) is in this range, practicable strength and image strength after fixation are good.

Block A is preferably an amorphous polymer.

In the exemplary embodiment, a glass transition temperature can be measured, for example, by the method prescribed in ASTM D3418-82 with a differential scanning calorimeter (DSDC) when measurement is performed from −80° C. to 150° C. at a temperature increasing rate of 10° C. every minute.

The melting point of crystalline block B (hereinafter sometimes also referred to as "mp (B)") is 25° C. or more or about 25° C. or more. When mp (B) is less than 25° C., preservation stability and mechanical strength of the toner are inferior. mp (B) is preferably 40 to 100® C. or about 40 to about 100° C., and more preferably 40 to 80° C. or about 40 to about 80° C. When mp (B) is in this range, a toner excellent in preservation stability and toner strength in the system can be obtained.

A melting point can be found as a melting peak temperature of input compensation differential scanning calorimetry shown in JIS K-7121 when measurement is performed from room temperature (25° C.) to 150° C. at a temperature increasing rate of 10° C. every minute. Incidentally, there are cases where crystalline resins show a plurality of melting peaks. In the exemplary embodiment, the maximum peak is taken as a melting point.

The glass transition temperature of crystalline block B (hereinafter sometimes also referred to as "Tg (B)") is preferably 20° C. or less or about 20° C. or less, and more preferably −100 to 10° C. or about −100 to about 10° C. When Tg (B) is in this range, a good fixing property can be obtained under pressure.

Further, the difference between Tg (A) and Tg (B) [Tg (A)−Tg (B)] is preferably 60° C. or more or about 60° C. or more, more preferably 70 to 200° C. or about 70 to about 200° C., and still more preferably 80 to 180° C. or about 80 to about 180° C. When the difference is in the above range, a sufficient pressure fixing property may be obtained, thus heat energy for fixation can be reduced.

Block A and crystalline block B are preferably polymers derived from ethylenically unsaturated compounds, and block A is more preferably an amorphous polymer derived from an ethylenically unsaturated compound.

In the exemplary embodiment, an ethylenically unsaturated compound is sufficient to be a compound having at least one ethylenically unsaturated bond, preferably an addition polymerizable compound, which may be any of anionic polymerizable, cationic polymerizable, radical polymerizable, and coordination polymerizable, and more preferably a radical polymerizable addition polymerization compound.

As the radical polymerizable ethylenically unsaturated compounds that may be used in the exemplary embodiment, styrenes (at least one of styrene and derivatives thereof), (meth)acrylates (description of "(meth)acrylate" has the same meaning as acrylate and/or methacrylate, and hereinafter the same), ethylenically unsaturated nitrites, ethylenically unsaturated carboxylic acids, vinyl ethers, vinyl ketones, and olefins are exemplified.

As block A and crystalline block B contained in the block copolymer, homopolymers derived from any one of these ethylenically unsaturated compounds, or copolymers obtained by copolymerization of two or more of these compounds can be used, but in the exemplary embodiment, preferably any one of block A and crystalline block B is a homopolymer, and more preferably both block A and crystalline block B are homopolymers.

Block A having a glass transition temperature of 60° C. or more is preferably a polymer derived from styrenes (at least one of styrene and derivatives thereof). As the styrenes, styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene are exemplified, and styrene can be preferably used of these styrenes.

Block A is preferably an amorphous polymer, and more preferably an amorphous polystyrene.

The ethylenically unsaturated compounds preferably used in the manufacture of crystalline block B are not especially restricted so long as they are compounds capable of obtaining crystalline blocks having a melting point of 25° C. or more, but preferably the monomer unit derived from the ethylenically unsaturated compound is capable of forming a side chain having 12 or more carbon atoms, more preferably capable of forming a side chain having 12 or more and 25 or less carbon atoms, and still more preferably capable of forming a side chain having 16 to 22 carbon atoms. In the above range of the numerical value, the volume resistance of the binder resin can be adjusted high, a toner little in variation of quantity of charge can be obtained, and deterioration of image quality due to splashing of the toner and generation of clouding in the image-forming apparatus can be restrained.

The side chain is preferably a straight chain or branched, and more preferably a straight chain. It is also preferred that the side chain is a saturated hydrocarbon group.

As the ethylenically unsaturated compounds for use in the manufacture of crystalline block B, (meth)acrylic alkyl esters are preferably exemplified, and acrylic alkyl esters are more preferred for the reason that the pressure fixing temperature can be restrained lower.

Acrylic alkyl esters having an alkyl group having 12 or more carbon atoms are preferred, those having an alkyl group having 12 to 25 carbon atoms are more preferred, and those having an alkyl group having 16 to 22 carbon atoms are still more preferred. In the above range of the numerical value, good polymerization reaction of acrylic alkyl esters can be ensured.

As the acrylic alkyl esters for use in the exemplary embodiment, cetyl acrylate, stearyl acrylate, and behenyl acrylate are preferred, stearyl acrylate and behenyl acrylate are more preferred for easy availability, and stearyl acrylate is still more preferred.

It is preferred for block A and crystalline block B to have a number average molecular weight of 5,000 to 100,000 or about 5,000 to about 100,000, more preferably 10,000 to 50,000 or about 10,000 to about 50,000, and still more preferably 20,000 to 40,000 or about 20,000 to about 40,000. When the number average molecular weight is in the above range, the mechanical strength of the toner against various stresses in the system, and balance of the fixing property under pressure and image strength after fixation is good.

The number average molecular weight can be measured, for example, with gel permeation chromatography (HLC-8120GPC, TSK-GEL, GMH columns, manufactured by TOSOH CORPORATION) on the following condition.

A solvent (tetrahydrofuran) is flown at a flow rate of 1.2 ml per minute at a temperature of 40° C., and measurement is carried out by pouring a tetrahydrofuran sample solution in concentration of 0.2 g/20 ml as a sample weight of 3 mg. In molecular weight measurement of the sample, measuring condition is selected so that the molecular weight of the sample is included in the range making a straight line in count number with the logarithms of the molecular weight of calibration curves produced by several kinds of monodispersed polystyrene standard samples.

The block copolymer satisfies equations (1) to (3).

$$30^\circ\text{ C.} \leqq [T(0.5\text{ MPa}) - T(30\text{ MPa})] \leqq 80^\circ\text{ C.} \quad (1)$$

$$60^\circ\text{ C.} \leqq T(0.5\text{ MPa}) \quad (2)$$

$$T(30\text{ MPa}) \leqq 80^\circ\text{ C.} \quad (3)$$

In formulae (1) to (3), T(0.5 MPa) represents the temperature at which the viscosity of the block copolymer is $10^4$ Pa·s when the pressure applied by a flow tester is 0.5 MPa, and T(30 MPa) represents the temperature at which the viscosity of the block copolymer is $10^4$ Pa·s when the pressure applied by a flow tester is 30 MPa.

When [T(0.5 MPa)−T(30 MPa)] shown in equation (1) is less than 30° C., the toner causes fixing failure, and so the fixed image strength is inferior. When [T(0.5 MPa)−T(30 MPa)] exceeds 80° C., the toner also causes a problem in the fixed image strength after fixation by fixing failure.

In the exemplary embodiment, it is preferred for the block copolymer to satisfy the following equation (4), and it is more preferred to satisfy the following equation (5).

$$40^\circ\text{ C.} \leqq [T(0.5\text{ MPa}) - T(30\text{ MPa})] \leqq 70^\circ\text{ C.} \quad (4)$$

$$50^\circ\text{ C.} \leqq [T(0.5\text{ MPa}) - T(30\text{ MPa})] \leqq 65^\circ\text{ C.} \quad (5)$$

To satisfy formula (4) or (5) is preferred in view of the fixing property.

When T(0.5 MPa) shown in equation (2) is less than 60° C., toner strength in the system reduces. T(0.5 MPa) is preferably 80 to 150° C., and more preferably 100 to 120° C.

T(30 MPa) shown in equation (3) is 80° C. or less, and when this value exceeds 80° C., a sufficient fixing property may not be obtained, so that a problem arises in the fixed image strength. T(30 MPa) is preferably 30 to 80° C. and more preferably 40 to 70° C.

The flow tester viscosity of the block copolymer can be found from the elution curve obtained from measurement of a cylindrical sample of diameter 1 cm×thickness 1 cm with a flow tester CFT-500C (die diameter: 0.5 mm, manufactured by Shimadzu Corporation) from room temperature to 200° C. at a temperature rising rate of 1° C. per minute.

For achieving the balance of sufficient pressure fixing performance and toner strength, the number average molecular weight of the block copolymer is preferably 10,000 to 150,000 or about 10,000 to about 150,000, more preferably 20,000 to 100,000 or about 20,000 to about 100,000, and still more preferably 40,000 to 70,000 or about 40,000 to about 70,000. When the numerical value is in the above range, compatibility of image quality characteristics by sufficient fixing property and toner strength in a developing apparatus is possible.

The number average molecular weight can be measured with gel permeation chromatography (HLC-8120GPC, TSK-GEL, GMH columns, manufactured by TOSOH CORPORATION). Measuring condition is as described above.

It is preferred for block A and crystalline block B to account for 60 wt % or more of the block copolymer at large, more preferably 80 to 100 wt %, and still more preferably 100 wt %. When the content of block A and crystalline block B is in the above range, good fixing property can be obtained under pressure.

It is especially preferred that the block copolymer is a diblock copolymer deriving from block A and crystalline block B.

Of the monomer units for constituting the block copolymer, the molar fraction of the monomer unit constituting crystalline block B is preferably 15 to 35% or about 15 to about 35%. When the numerical value is in the above range, practicable strength as toner, image strength after fixation, and charging characteristics of the toner are obtained, so that splashing of the toner and generation of clouding in the image-forming apparatus can be restrained. Further, the weight fraction of crystalline block B in the block copolymer is preferably 40 to 65 wt % or about 40 to about 65 wt %.

When the numerical value is in the above range, practicable strength as toner, image strength after fixation, and excellent charging characteristics of the toner are obtained, and so splashing of the toner and generation of clouding in the image-forming apparatus are preferably restrained.

The volume resistance (specific volume resistance) of the block copolymer is preferably $1\times10^{13}$ to $1\times10^{16}$ Ωcm or about $1\times10^{13}$ to about $1\times10^{16}$ Ωcm, and more preferably $1\times10^{14}$ to $1\times10^{15}$ Ωcm or about $1\times10^{14}$ to about $1\times10^{15}$ Ωcm. When the numerical value is in the above range, a toner having excellent charge maintaining characteristic can be obtained.

The volume resistance can be measured according to the method of ASTM D257.

In manufacturing the block copolymer, various living polymerization methods, e.g., conventional methods such as an ionic polymerization methods and living radical polymerization methods can be used. In the exemplary embodiment, living radical polymerization methods are preferably used for easiness of combination of monomers.

In this case, as living radical polymerization methods, conventional methods, e.g., NMRP method (Nitroxide Mediated Radical Polymerization), ATRP method (Atom Transfer Radical Polymerization), and RAFT method (Reversible Addition Fragmentation Transfer) can be used. Above all, NMRP method is preferably used in the exemplary embodiment.

As the nitroxide compounds for use in NMRP method, conventional nitroxide compounds used in living radical polymerization methods can be used. Specifically, the compounds disclosed in JP-A-2004-307502, JP-A-2005-126442, JP-A-2007-518843, and Japanese Patent No. 4081112 can be used. In the exemplary embodiment, monoalkoxylamine represented by the following formula (I) can be preferably used.

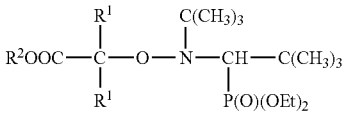

(I)

In formula (I), $R^1$ represents an alkyl group having a straight chain or branched chain having 1 to 5 carbon atoms; and $R^2$ represents a hydrogen atom, an alkyl group having a straight chain or branched chain having 1 to 8 carbon atoms, an aryl group having 6 to 20 carbon atoms, an alkali metal ion, or an ammonium ion.

$R^1$ represents an alkyl group having a straight chain or branched chain having 1 to 5 carbon atoms, preferably a straight chain alkyl group having 1 to 3 carbon atoms, and more preferably a methyl group.

$R^2$ represents a hydrogen atom, an alkyl group having a straight chain or branched chain having 1 to 8 carbon atoms, an aryl group having 6 to 20 carbon atoms, an alkali metal ion, or an ammonium ion. As the alkyl group having a straight chain or branched chain having 1 to 8 carbon atoms, a methyl group, an ethyl group, etc., are exemplified, as the aryl group having 6 to 20 carbon atoms, a phenyl group, etc. is exemplified, as the alkali metal ion, $Li^+$, $Na^+$, $K^+$, etc., are exemplified, and as the ammonium ion, $NH_4^+$, $NBu_4^+$, $HNBu_3^+$, etc., are exemplified. In the exemplary embodiment, $R^2$ preferably represents a hydrogen atom.

The NMRP method is preferably performed under a nitrogen atmosphere.

It is preferred to perform reaction in the presence or absence of a solvent selected from, preferably alcohol such as ethanol, an aromatic solvent, a chlorinated solvent, ether, and a polar non-proton solvent, and more preferably reaction is performed in the absence of a solvent.

The reaction temperature is preferably in the range of 30 to 90° C., and more preferably 50 to 90° C.

The use amount of the nitroxide compound can be determined from the number average molecular weight at the time of polymerization termination. In general, the amount of the nitroxide compound to be used can be stoichiometrically found from the amount of monomers to be used and number average molecular weights.

In the exemplary embodiment, the content of the block copolymer is preferably 50 to 99 wt % on the basis of 100 wt % of the electrostatic image developing toner, and more preferably 70 to 95 wt %. When the content is in this range, excellent fixing ability can be ensured in pressure fixation or pressure heating fixation.

The electrostatic image developing toner in the exemplary embodiment may further contain resins other than the block copolymer, for example, the toner may contain resins having Tg of 40° C. or higher. By compounding resins having Tg of 40° C. or higher in the electrostatic image developing toner, it is possible to further improve mechanical stability of the toner in the electrophotographic process. In the exemplary embodiment, a shell layer may be formed on the surface of the electrostatic image developing toner with the resins having Tg of 40° C. or higher.

As other resins, polycondensation resins such as polyester resins, and polymers derived from ethylenically unsaturated compounds are preferably exemplified. In this case, as the polycondensation resins, amorphous polyester resins and crystalline polyester resins are preferred. In the light of the improvement of mechanical stability of the toner, amorphous polyester resins are more preferred.

The polyester resins can be manufactured by polycondensation by direct esterification reaction, ester exchange reaction, etc., using polycondensation monomers such as polyvalent carboxylic acids, polyhydric alcohols, hydroxycarboxylic acids, etc. In the polycondensation reaction, it is preferred to use polycondensation catalysts in combination for accelerating the polycondensation reaction.

In the exemplary embodiment, the polyvalent carboxylic acids include aliphatic, alicyclic and aromatic polyvalent carboxylic acids, and alkyl esters, acid anhydrides, and acid halides thereof The polyhydric alcohols include polyhydric alcohols and ester compounds thereof The alkyl esters of polyvalent carboxylic acids are preferably lower alkyl esters. The lower alkyl esters are alkyl esters in which the carbon atom number of the alkoxy portion is 1 to 8. Specifically, methyl ester, ethyl ester, n-propyl ester, isopropyl ester, n-butyl ester, isobutyl ester and the like are exemplified.

Of the polyvalent carboxylic acids usable in the exemplary embodiment, the examples of dicarboxylic acids include oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecenylsuccinic acid, dodecanedicarboxylic acid, fumaric acid, citraconic acid, diglycolic acid, cyclohexanedicarboxylic acid, cyclohexane-3,5-diene-1,2-dicarboxylic acid, 2,2-dimethylolbutanoic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracenedicarboxylic acid, dodecenylsuccinic acid, etc., can be exemplified.

As polyvalent carboxylic acids other than dicarboxylic acids, for example, trimellitic acid, pyromellitic acid, naphthalenetricarboxylic acid, naphthalenetetracarboxylic acid, pyrenetricarboxylic acid, pyrenetetracarboxylic acid, etc., are exemplified.

These polyvalent carboxylic acids may be used by one kind alone, or two or more kinds may be used in combination.

Of the polyhydric alcohols (polyols), the examples of diols include ethylene glycol, propylene glycol, butanediol, diethylene glycol, triethylene glycol, hexanediol, cyclohexanediol, octanediol, decanediol, dodecanediol, ethylene oxide adducts of bisphenol A, propylene oxide adducts of bisphenol A, bisphenoxy alcohol fluorene (bisphenoxy ethanol fluorine), etc., can be exemplified.

As polyols other than diols, for example, glycerin, pentaerythritol, hexamethylolmelamine, hexaethylolmelamine, tetramethylolbenzoguanamine, tetraethylolbenzoguanamine, etc., are exemplified.

These polyhydric alcohols (polyols) may be used by one kind alone, or two or more kinds may be used in combination.

The ethylenically unsaturated compounds may be monomers having a hydrophilic group.

As the hydrophilic groups, polar groups, such as acidic polar groups, e.g., a carboxyl group, a sulfo group, a phosphonyl group, etc.; basic polar groups, e.g., an amino group; and neutral polar groups, e.g., an amido group, a hydroxyl group, a cyano group, a formyl group, etc., can be exemplified, but the exemplary embodiment is not restricted thereto.

Of these hydrophilic groups, groups especially preferably used in the electrostatic image developing toner in the exemplary embodiment are acidic polar groups. By the presence of the monomers having the acidic polar group and an ethylenically unsaturated bond on the surfaces of resin particles in a specific range, an aggregating property is given to the resin particles, so that the resin particles can be easily used in the toner, and a sufficient charging property can be given to the toner.

As the acidic polar groups preferably used, a carboxyl group and a sulfo group are exemplified. As the monomers having this acidic polar group, for example, an α,β-ethylenically unsaturated compound having a carboxyl group and an α,β-ethylenically unsaturated compound having a sulfo group can be exemplified. As the α,β-ethylenically unsaturated compound having a carboxyl group, e.g., acrylic acid, methacrylic acid, fumaric acid, maleic acid, itaconic acid, cinnamic acid, monomethyl maleate, monobutyl maleate, and octyl maleate can be exemplified. These monomers may be used by one kind alone, or two or more kinds may be used in combination.

Other resins are, when they are polymers derived from ethylenically unsaturated compounds, preferably random copolymers.

Further, resins containing monomer units derived from an ethylenically unsaturated compound having a hydrophilic group are preferred, and it is preferred to contain a monomer unit derived from an ethylenically unsaturated compound having a hydrophilic group in copolymerization ratio of 0.1 to 10 mol %. When the numerical value is in the above range, since other resin having Tg of 40° C. or higher can easily form a shell layer in the manufacturing process of the electrostatic image developing toner in an aqueous medium, and so preferred.

The content of other resins described above is preferably 50 wt % or less of all the binder resins contained in the toner, and more preferably 5 to 20 wt %. When the content is in the above range, durability of the toner in a developing machine is improved and stable image quality characteristics can be ensured.

2. Coloring Agent

The electrostatic image developing toner in the exemplary embodiment preferably contains a coloring agent.

As the coloring agent, known coloring agents can be used and arbitrarily selected considering hue angle, chroma, brightness, weather resistance, OHP transparency, and dispersibility in toners.

As the specific examples of the coloring agents that can be used in the exemplary embodiment, various kinds of pigments, such as carbon black, Chrome Yellow, Hansa Yellow, Benzidine Yellow, Indanthrene Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Chalcooil Blue, Methylene Blue Chloride, Phthalocyanine Blue, Phthalocyanine Green, Malachite Green Oxalate, titanium black, etc.; and various kinds of dyes, such as acridine series, xanthene series, azo series, benzoquinone series, azine series, anthraquinone series, dioxazine series, thiazine series, azomethine series, indigo series, thioindigo series, phthalocyanine series, aniline black series, polymethine series, triphenylmethane series, diphenylmethane series, thiazine series, thiazole series, xanthenes series, etc., are exemplified.

As the coloring agents, specifically carbon black, Nigrosine dye (C.I. No. 50415B), Aniline Blue (C.I. No. 50405), Chalcooil Blue (C.I. No. azoic Blue 3), Chrome Yellow (C.I. No. 14090), Ultramarine Blue (C.I. No. 77103), Du Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengal (C.I. No. 45435), and mixtures of these coloring agents are preferably used.

The use amount of the coloring agents is preferably 0.1 to 20 wt % on the basis of 100 wt % of the toner, and more preferably 0.5 to 10 wt %. As coloring agents, these pigments and dyes may be used by one kind alone, or two or more kinds may be used in combination.

When the later-described magnetic powders are used as black coloring agent, there are cases where they are used in an amount of 12 to 240 wt % unlike other coloring agents.

3. Releasing Agent

The electrostatic image developing toner in the exemplary embodiment preferably contains a releasing agent.

The specific examples of the releasing agents that can be used in the exemplary embodiment include low molecular weight polyolefins, e.g., various kinds of ester waxes, polyethylene, polypropylene, polybutene, etc.; silicones showing a softening temperature by heating; fatty acid amides, e.g., oleic acid amide, erucic acid amide, ricinoleic acid amide, stearic acid amide, etc.; vegetable waxes, e.g., carnauba wax, rice wax, candelilla wax, Japan wax, jojoba oil, etc.; animal waxes, e.g., bees wax, etc.; mineral and petroleum waxes, e.g., montan wax, ozokerite, ceresine, paraffin wax, microcrystalline wax, Fischer-Tropsch wax, etc.; and modifies products of them.

In the electrostatic image developing toner in the exemplary embodiment, the content of the releasing agent is preferably 1 to 20 wt % on the basis of 100 wt % of the binder resin, and more preferably 3 to 15 wt %. When the numerical value is in the above range, compatibility of good fixing and image quality characteristics can be ensured.

4. Internal Additives and Other Additives

Various kinds of internal additives generally used in these kinds of toners, such as a charge controlling agent, an antioxidant, an ultraviolet absorber and the like may be used, if necessary, in the electrostatic image developing toner in the exemplary embodiment.

As the charge controlling agents, known compounds such as positive charge controlling agents, e.g., Nigrosine dyes, quaternary ammonium salt compounds, triphenylmethane compounds, imidazole compounds, polyamine resins, etc.; and negative charge controlling agents, e.g., azo compounds containing metals, such as chromium, cobalt, aluminum, iron, etc., metal salts and metal complexes of chromium, zinc, aluminum, etc., of hydroxycarboxylic acid, e.g., salicylic acid or alkyl salicylate, benzyl acid, etc., amide compounds, phenol compounds, naphthol compounds, phenolamide compounds, etc., are used.

The electrostatic image developing toner in the exemplary embodiment may contains, if necessary, a flame retardant and an auxiliary flame retardant. As the flame retardants and auxiliary flame retardants, generally used bromine series flame retardants, antimony trioxide, magnesium hydroxide, aluminum hydroxide, and ammonium polyphosphate are exemplified, but the exemplary embodiment is not restricted thereto.

When the electrostatic image developing toner in the exemplary embodiment is used as a magnetic toner, magnetic may be contained. Specifically, materials to be magnetized in a magnetic field are used, and ferromagnetic powders such as iron, cobalt and nickel, or compounds such as ferrite and magnetite are used.

When a toner is obtained in an aqueous phase in the exemplary embodiment, it is necessary to pay attention to aqueous phase transition of the magnetic powders, and it is preferred to modify the surfaces of magnetic powders, e.g., by hydrophobitization treatment.

Further, for the purpose of giving flowability and improving a cleaning property, inorganic particles such as silica, alumina, titania, calcium carbonate, etc., and resin particles such as vinyl resins, polyester, silicone, etc., may be optionally adhered to the surfaces of the electrostatic image developing toner particles of the exemplary embodiment while applying shear in a dried state after drying similarly to ordinary toners before use.

When these particles are adhered to the toner surface in an aqueous medium, as the examples of inorganic particles, all the particles ordinarily used as the external additives of toner surface, such as silica, alumina, titania, calcium carbonate, magnesium carbonate, and tricalcium phosphate are used by dispersing with ionic surfactants, polymeric acids or polymeric bases.

5. Volume Average Particle Size, Particle Size Distribution, Shape Factor

The volume average particle size ($D_{50v}$) of the electrostatic image developing toner in the exemplary embodiment is preferably 2 to 10 μm or about 2 to about 10 μm, more preferably 3 to 8 μm or about 3 to about 8 μm, and still more preferably 5 to 7 μm or about 5 to about 7 μm. When the numerical value is in the above range, good image quality characteristics after fixation can be obtained.

The particle size distribution of the toner is preferably narrow. More specifically, the ratio of 16% particle size ($D_{16p}$) and 84% particle size ($D_{84p}$) from the small particle size side in terms of number average particle size of the toner and shown as square root ($GSD_p$), i.e., the later-described $GSD_p$, is preferably 1.40 or less or about 1.40 or less, more preferably 1.31 or less or about 1.31 or less, and especially preferably 1.27 or less or about 1.27 or less. $GSD_p$ is preferably 1.15 or more.

When both of the volume average particle size and $GSD_p$ are in the above ranges, extremely minute particles are not present, so that lowering of developability attributing to excessive charging quantity of small particle size toner is inhibited.

The volume average primary particle sizes of particles such as resin particles and toner particles, number average particle size distribution index, and volume average particle size distribution index can be measured with measuring instruments, such as Coulter Counter model TA-II (manufactured by Beckmann Coulter, Inc.), and Multisizer II (manufactured by Beckmann Coulter, Inc.). In this case, measurement is performed with an optimal aperture according to the particle size level of the particle. When particle size of the particle is about 5 μm or less, measurement is performed with a laser diffraction scattering system particle size distribution measuring instrument (LA-700, manufactured by Horiba, Ltd.). The cumulative distributions of the volume and the number are drawn from the small size side in connection with the particle size ranges (channels) divided based on the particle size distribution. The particle sizes giving accumulation of 16% are designated as $D_{16v}$ for volume and $D_{16p}$ for number, the particle sizes giving accumulation of 50% are designated as $D_{50v}$ for volume and $D_{50p}$ for number, and the particle sizes giving accumulation of 84% are designated as $D_{84v}$ for volume and $D_{84p}$ for number. By using these values, the volume average particle size distribution index ($GSD_v$) is computed as $(D_{84v}/D_{16v})^{1/2}$, and the number average particle size distribution index ($GSD_p$) is computed as $(D_{84p}/D_{16p})^{1/2}$.

The shape factor SF1 of electrostatic image developing toner is preferably in the range of 110 to 145, and more preferably 120 to 140. The shape factor SF1 is a shape factor to show the degree of unevenness of particle surface and computed from the following equation.

$$SF1 = \frac{(ML)^2}{A} \times \frac{\pi}{4} \times 100$$

In the formula, ML represents the maximum length of the particle, and A represents the projected area of the particle.

SF1 is specifically measured, for example, as follows. An optical micrograph of the toner scattered on a slide glass is imported into an image analyzer through a video camera, and SF1 is computed of fifty toner particles and the average value is found.

6. Quantity of Charge

The quantity of charge of the electrostatic image developing toner in the exemplary embodiment is preferably in the range of 10 to 40 μC/g or about 10 to about 40 μC/g as the absolute value, and more preferably 15 to 35 μC/g or about 15 to about 35 μC/g. When the numerical value is in the above range, the background is free from blur (fogging), and image density does not lower.

The quantity of charge can be measured as follows. After mixing sample particles, a toner, and the counterpart particles of friction giving charge, a carrier, and sufficiently causing triboelectrification in advance, both are separated by wind force, centrifugal force, mechanical force, impact force, electrostatic force, or vibration, and the quantity of charge left in the separated one side is measured. For example, 7.5 weight parts of a toner is added to 100 weight parts of a carrier and mixed for 5 minutes in a room temperature atmosphere (25° C., humidity of 60%), and the quantity of charge is measured with a charge quantity-measuring instrument. As charge quantity-measuring instrument, a powder charge quantity-measuring instrument TB2-3 (manufactured by Kyocera Chemical Corporation) is exemplified.

II. Manufacturing Method of Electrostatic Image Developing Toner

The manufacturing method of the electrostatic image developing toner (hereinafter sometimes referred to as merely "the manufacturing method of the toner") is not especially restricted, and conventional manufacturing methods such as a kneading and grinding method, chemical manufacturing methods such as a suspension polymerization method and an emulsion aggregation method can be utilized. In the exemplary embodiment, the manufacturing method is preferably a method including a dispersion process of manufacturing resin particle dispersion containing the block copolymer, an aggregation process of aggregating the dispersed resin particles to obtain aggregated particles, and a fusion process of fusing the aggregated particles by heating. When the manufacturing method of the toner in the exemplary embodiment includes the dispersion process, the emulsion aggregation method or the suspension method is preferably used as the manufacturing method of the toner in the exemplary embodiment.

The manufacturing method of the electrostatic image developing toner in the exemplary embodiment will be described below.

<Dispersion Process>

As the dispersion process of manufacturing resin particle dispersion containing the block copolymer in the exemplary embodiment, conventional dispersion methods are used. For example, a shearing emulsifying method of, after the block copolymer has been polymerized in advance by bulk polymerization or solution polymerization, dispersing the block copolymer in an aqueous medium by various kinds of mechanical high shear forces by means of a rotating shearing type homogenizer, a ball mill, a sand mill, a Dyno-mill, each of which has media, or a pressure-ejecting type disperser (a MANTON GAULIN HOMOGENIZER, manufactured by Manton Gaulin), a phase inversion emulsifying method of dissolving the resin in an organic solvent, and then adding an aqueous medium to invert the phase, and a method of manufacturing the resin particle dispersion of the block copolymer by mixing the block copolymer or the precursor thereof (living terminal low molecular weight compound or a block) with a small amount of an ethylenically unsaturated compound, shearing emulsifying, phase inversion emulsifying, and then performing mini-emulsion polymerization, suspension polymerization are used.

In the mini-emulsion polymerization or suspension polymerization, it is preferred not to use an organic solvent in dissolving the block copolymer or the precursor thereof, and it is more preferred to dissolve the block copolymer or the precursor thereof with a small amount of an ethylenically unsaturated compound alone.

In the mini-emulsion polymerization or suspension polymerization, as the ethylenically unsaturated compound to be mixed with the block copolymer, an ethylenically unsaturated compound capable of becoming a polymer having Tg of 40° C. or more after polymerization is preferred. As such ethylenically unsaturated compounds, styrene, butyl acrylate and 2-ethylhexyl acrylate are specifically preferably exemplified.

In the exemplary embodiment, as the "aqueous medium", for example, water such as distilled water and ion exchange water, and the water to which alcohols such as ethanol or methanol is added are exemplified. A mixed liquid of ethanol and water is preferred, and water such as distilled water and ion exchange water are more preferred. These aqueous media may be used by one kind alone, or two or more kinds may be used in combination.

Further, the aqueous medium may contain a water-miscible organic solvent besides the alcohols. As the water-miscible organic solvents, e.g., acetone and acetic acid are exemplified.

In the manufacture of resin particle dispersion, there are cases where various kinds of ionic surfactants such as anionic surfactants and cationic surfactants, nonionic surfactants, inorganic dispersants, and polymer type dispersants are used.

As the anionic surfactants, for example, sodium dodecylbenzenesulfonate, sodium alkylnaphthalenesulfonate, sodium aylalkyl polyether sulfonate, 3,3-disulfone-N,N-diphenylurea, sodium 4,4-diazo-bis-amino-8-naphthol-6-sulfonate, ortho-carboxybenzene-azo-dimethylaniline, sodium 2,2,5,5-tetramethyltriphenylmethane-4,4-diazo-bis-β-naphthol-6-sulfonate, sodium dialkylsulfosuccinate, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate, and potassium oleate are exemplified.

As the cationic surfactants, alkylbenzenedimethylammonium chloride, alkyltrimethylammonium chloride, and distearylammonium chloride are exemplified.

As the nonionic surfactants, water-soluble and oil-soluble surfactants, such as polyethylene oxide, polypropylene oxide, combinations of polypropylene oxide and polyethylene oxide, esters of polyethylene glycol and higher fatty acid, alkylphenol polyethylene oxide, esters of higher fatty acid and polyethylene glycol, esters of higher fatty acid and polypropylene oxide, and sorbitan ester are exemplified.

As the polymeric colloid stabilizers, sodium polycarboxylate and polyvinyl alcohol, and as the inorganic dispersants, calcium carbonate are respectively exemplified, but the exemplary embodiment is by no means restricted thereto.

Further, pH of aqueous dispersion is adjusted with sodium hydroxide, potassium hydroxide, or ammonia.

In the mini-emulsion method, a small amount of co-stabilizer is optionally used in combination. The co-stabilizer is water-insoluble or hardly water-soluble and soluble in an oil phase. Co-stabilizers conventionally used in mini-emulsion polymerization are used.

As the examples of preferred co-stabilizers, alkanes having 8 to 30 carbon atoms, e.g., dodecane, hexadecane, octadecane, etc., alkyl alcohols having 8 to 30 carbon atoms, e.g., lauryl alcohol, cetyl alcohol, stearyl alcohol, etc., alkyl(meth)acrylate having 8 to 30 carbon atoms, e.g., lauryl(meth)acrylate, cetyl(meth)acrylate, stearyl(meth)acrylate, etc., alkanethios having 8 to 30 carbon atoms, e.g., dodecanethiol, lauryl mercaptan, cetyl mercaptan, stearyl mercaptan, etc., polymers or poly-adducts, e.g., polystyrene, polymethyl methacrylate, etc., carboxylic acids, ketones, amines, etc., are exemplified.

In the case where the block copolymer or precursor thereof is mixed with an ethylenically unsaturated compound in shearing emulsification and phase inversion emulsification, a process of polymerizing the ethylenically unsaturated compound may be included. As the ethylenically unsaturated compounds, styrene and derivatives thereof, acryl ester and derivatives thereof, methacryl ester and derivatives thereof are exemplified.

Polymerization methods are not especially restricted, but ordinarily used polymerization methods in an aqueous medium, such as a suspension polymerization method, a dissolution suspension method, a mini-emulsion method, a micro-emulsion method, and an emulsification polymerization method including a multi-stage swelling method and seed polymerization can be used, and two or more kinds of polymerization methods may be used in combination.

As the polymerization method of the ethylenically unsaturated compound, conventionally known methods, such as methods using polymerization initiators, self-polymerization methods by heat, and methods using ultraviolet irradiation can be adopted, and methods using polymerization initiators are preferred of these methods.

Polymerization initiators are not especially restricted, but known radical polymerization initiators, cation polymerization initiators, and anion polymerization initiators can be used. There are two kinds of polymerization initiators of water-soluble and oil-soluble polymerization initiators, and both initiators can be optionally used considering decomposition temperature, i.e., activation temperature.

The ethylenically unsaturated compound is a radical polymerizable monomer, and the polymerization initiator is preferably a radical polymerization initiator. There are oil-soluble initiators and water-soluble initiators as radical polymerization initiators, and either may be used. The specific examples of the radical polymerization initiators include azobisnitriles, e.g., 2,2'-azobis(2-methylpropionitrile), 2,2'-azobis-(2-methylbutyronitrile), 2,2'-azobisisobutyronitrile), 2,2'-azobis(2,4-dimethyl-valeronitrile), 2,2'-azobis(2,4-dimethyl-4-methoxyvaleronitrile), 1,1'-azobis-(cyclohexanecarbonitrile), 2,2'-azobis(2-amidinopropane) hydrochloride, etc.; organic peroxides, such as diacyl peroxides, e.g., acetyl peroxide, octanoyl peroxide, 3,5,5-trimethylhexanoyl peroxide, decanoyl peroxide, lauroyl peroxide, benzoyl peroxide, etc.; dialkyl peroxides, e.g., di-t-butyl peroxide, t-butyl-α-cumyl peroxide, dicumyl peroxide, etc.; peroxy esters, e.g., t-butylperoxy acetate, α-cumylperoxy pivalate, t-butylperoxy octoate, t-butylperoxy neodecanoate, t-butylperoxy laurate, t-butylperoxy benzoate, di-t-butylperoxy phthalate, di-t-butylperoxy isophthalate, etc.; hydroperoxides, e.g., t-butylhydroperoxide, 2,5-dimethylhexane-2,5-dihydroperoxide, cumenehydroperoxide, diisopropylbenzenehydroperoxide, etc.; peroxy carbonates, e.g., t-butylperoxyisopropyl carbonate, etc.; inorganic peroxides, such as hydrogen peroxide, etc.; and persulfates, such as potassium persulfate, sodium persulfate, ammonium persulfate, etc. Further, there is a case where a redox polymerization initiator is used in combination.

In addition polymerization, a chain transfer agent may be used. The chain transfer agent is not especially restricted. Specifically, those having a covalent bond of a carbon atom and a sulfur atom are preferably used, for example, thiols are preferably exemplified.

When the toner of the exemplary embodiment is manufactured according to the emulsion aggregation method, it is preferred for the manufacturing method of the toner of the exemplary embodiment to include an aggregation process of aggregating the dispersed resin particles to obtain aggregated particles, and a fusion process of fusing the aggregated particles by heating.

As the aggregation process, for example, a process of mixing the resin particle dispersion, preferably with a coloring agent particle dispersion and a releasing agent particle dispersion, further adding an aggregating agent to cause hetero aggregation and form aggregated particles having the particle size of the toner is exemplified. The medium of each dispersion is preferably an aqueous medium. In the aggregation process, resin particles other than the resin particles of the block copolymer may be added, preferably resin particles such as a polymer having Tg of 40° C. or higher and derived from an ethylenically unsaturated compound and/or crystalline polyester.

The dispersing methods of the coloring agent and releasing agent are not especially restricted, and optional methods, e.g., a rotating shearing type homogenizer, a ball mill, a sand mill, a Dyno-mill, each of which has media, a homogenizer having strong shear force, or a pressure-ejecting type disperser (a MANTON GAULIN HOMOGENIZER, manufactured by Manton Gaulin), can be used. These coloring agent particles and releasing agent particles may be added to a mixed solvent with other particle components at once, or may be divided and added in a multistage.

It is also possible to form the first aggregated particles by aggregation as above and form the second shell layer on the surfaces of the first aggregated particles by the addition of the above resin particle dispersion or other resin particle dispersion. The material of the second shell layer is preferably the above resin having Tg of 40° C. or higher.

In the above example, the coloring agent particle dispersion is prepared separately, but in the case where a coloring agent is mixed in advance in resin particles, a coloring agent particle dispersion is not necessary, and this is also the same with the releasing agent.

When the emulsion aggregation method is used in the manufacturing method of the electrostatic image developing toner in the exemplary embodiment, the particle size of the toner particles containing a binder resin and a coloring agent can be adjusted by causing aggregation in the aggregation process by pH change and the like. An aggregating agent may be added at the same time for the purpose of stabilizing and expediting aggregation of particles, or for obtaining aggregated particles having narrower particle size distribution.

As the aggregating agent, a compound having monovalent or more electric charge is preferred. As the specific examples of such compounds, water-soluble surfactants such as above-described ionic surfactants and nonionic surfactants, acids, e.g., hydrochloric acid, sulfuric acid, nitric acid, acetic acid, oxalic acid, etc., metal salts of inorganic acids, e.g., magnesium chloride, sodium chloride, aluminum sulfate, calcium sulfate, ammonium sulfate, aluminum nitrate, silver nitrate, copper sulfate, sodium carbonate, etc., metal salts of aliphatic acids, e.g., sodium acetate, potassium formate, sodium oxalate, sodium phthalate, potassium salicylate, etc., metal salts of aromatic acids, metal salts of phenols, e.g., sodium phenoxide, etc., are exemplified.

Considering the stability of the aggregated particles, the stability of the aggregating agent against heat and aging, and removal of the aggregating agent in washing, metal salts of inorganic acids are preferred as the aggregating agent in the points of performance and use. Specifically, metal salts of inorganic acids such as magnesium chloride, sodium chloride, aluminum sulfate, calcium sulfate, ammonium sulfate, aluminum nitrate, silver nitrate, copper sulfate, and sodium carbonate are exemplified.

The addition amount of these aggregating agents varies in accordance with the valence of electric charge, but the difference is small in any case. Preferably, the case of monovalent is 3 wt % or less, divalent is 1 wt % or less, and trivalent is 0.5 wt % or less. Since the amount of an aggregating agent is preferably small, it is preferred to use a compound having a high valence.

Further, for the purpose of preventing a coloring agent from bleeding from the surfaces of particles after aggregation treatment, the surfaces of particles may be crosslinked by heat treatment and the like. If necessary, the used surfactant may be removed by washing with water, washing with acid, or with alkali.

The median size of other resin particles in the resin particle dispersion that can be used in the exemplary embodiment is preferably 0.1 to 2.0 μm.

Further, the median size of the releasing agent particles of the coloring agent particle dispersion and the median size of the releasing agent particles of the releasing agent particle dispersion that can be used in the aggregation process is preferably 0.1 to 2.0 μm.

As the fusion process, a process of heating the aggregated particles at the temperature of the glass transition temperature of the resin particles or higher or the melting point or higher to fuse and coalesce is exemplified. The temperature for the fusion and coalescence is preferably higher than the melting point or glass transition temperature of the resin for use in the block copolymer The binder resin in the aggregated particles is melted by such temperature condition, and aggregated particles change from amorphous to spherical.

After termination of the aggregation process and fusion process, the resin particles may be treated through optional washing process, solid-liquid separation process, and drying process. In the washing process, it is preferred to perform sufficient substitution washing with ion exchange water from the point of charging property. The solid-liquid separation process is not especially restricted but suction filtration and pressure filtration are preferred from the point of productivity. The drying process is also not especially restricted, but freeze drying, flash jet drying, fluidized drying, and oscillatory type fluidized drying are preferably used from the point of productivity.

Incidentally, if necessary, various kinds of internal additives generally used in these kinds of toners, such as a charge controlling agent, an antioxidant, an ultraviolet absorber and the like may be used in the manufacturing method of the electrostatic image developing toner in the exemplary embodiment.

These additives may be added in any process. Further, the charge controlling agent is preferably added as an aqueous dispersion, and the addition amount of the charge controlling agent is preferably 1 to 25 wt % per 100 wt % of the oil phase, and more preferably 5 to 15 wt %. Here, the oil phase is a solid content exclusive of organic solvents and the like from the components emulsified and dispersed in the aqueous medium.

III. Electrostatic Image Developer

The electrostatic image developing toner in the exemplary embodiment is used as an electrostatic image developer (hereinafter also referred to as "developer"). The developer is not especially restricted except for containing the electrostatic image developing toner in the exemplary embodiment, and optional component composition may be taken according to the purpose. When the electrostatic image developing toner is used alone, it is prepared as one-component electrostatic image developer, and when used in combination with a carrier, it is prepared as two-component electrostatic image developer. As one-component developer, a developing method of forming a charged toner by triboelectrification of the developer with a developing sleeve or a charging member and developing according to the electrostatic latent image may also be used.

The carrier is not especially restricted, but generally resin-covered carrier with magnetic particles, e.g., iron powder, ferrite, iron oxide powder, nickel, or the like, as a core material, and covered with a resin-covering layer, such as resin, e.g., styrene resin, vinyl resin, ethylene resin, rosin resin, polyester resin, melamine resin, etc., or wax, e.g., stearic acid or the like; and magnetic powder dispersion type carrier comprising a binder resin having dispersed therein magnetic powder are exemplified. Of these carriers, the resin-covered carrier is especially preferred in the point of capable of controlling the charging ability of the toner and the resistance of the carrier at large with the constitution of the resin-covering layer.

The mixing ratio of the electrostatic image developing toner in the exemplary embodiment and carrier in two-component electrostatic image developer is preferably 2 to 10 weight parts of the electrostatic image developing toner to 100 weight parts of the carrier. The manufacturing method of the developer is not especially restricted, and a method of mixing the toner and a carrier with a V blender and the like is exemplified.

IV. Image-Forming Method and Image-Forming Apparatus

The electrostatic image developing toner in the exemplary embodiment and the electrostatic image developer in the exemplary embodiment can be used in the image-forming method of an ordinary electrostatic image developing system (an electrophotographic system), and they are especially preferably used in the image-forming method and image-forming apparatus of the exemplary embodiment.

The image-forming method of the exemplary embodiment comprises an electrostatic latent image-forming process of forming an electrostatic latent image on the surface of an electrostatic latent image holding member, a developing process of forming a toner image by developing the electrostatic latent image formed on the surface of the electrostatic latent image holding member with a developer containing a toner, a transfer process of transferring the toner image to the surface of a transfer-receiving material, and a fixing process of fixing the toner image by applying pressure, wherein the toner is the electrostatic image developing toner of the exemplary embodiment, or the electrostatic image developing toner manufactured by the manufacturing method of the exemplary embodiment, or the developer is the electrostatic image developer of the exemplary embodiment, and the fixing pressure in the fixing process is 0.5 to 30 MPa or about 0.5 to about 30 MPa.

The image-forming apparatus of the exemplary embodiment has a latent image holding member, a charging unit for charging the latent image holding member, an exposure unit for forming an electrostatic latent image on the surface of the latent image holding member by exposing the charged latent image holding member, a developing unit of developing the electrostatic latent image with a developer containing a toner to form a toner image, a transfer unit of transferring the toner image from the latent image holding member to the surface of a transfer-receiving material, and a fixing unit of applying pressure to the toner image transferred to the surface of the transfer-receiving material, wherein the fixing pressure of the fixing unit is 0.5 to 30 MPa, and the toner is the electrostatic image developing toner of the exemplary embodiment, or the electrostatic image developing toner manufactured by the manufacturing method of the exemplary embodiment, or the developer is the electrostatic image developer of the exemplary embodiment, and the fixing pressure in the fixing process is 0.5 to 30 MPa.

In the transfer process or the transfer unit, a transfer process or the transfer unit for performing transfer two or more times with an intermediate transfer body may be provided.

In the image-forming apparatus of the exemplary embodiment, a part including the developing unit may have a cartridge structure (a process cartridge) attachable to and detachable from the image-forming apparatus main body.

As the process cartridge, a process cartridge according to the exemplary embodiment having at least a developer holding member for holding the electrostatic image developing toner in the exemplary embodiment or electrostatic image developer in the exemplary embodiment is preferably used.

The electrostatic latent image-forming process is a process for forming an electrostatic latent image on the surface of an electrostatic latent image holding member.

The developing process is a process for forming a toner image by developing the electrostatic latent image with a developer layer on a developer holding member. The developer layer is not especially restricted so long as it contains the electrostatic image developer in the exemplary embodiment containing the electrostatic image developing toner in the exemplary embodiment.

The transfer process is a process for transferring the toner image to the surface of a transfer-receiving material.

Each of the above processes excluding the fixing process is an ordinary process in itself and disclosed, e.g., in JP-A-56-40868 and JP-A-49-91231.

The fixing process is a process for fixing the toner image on a transfer-receiving material such as paper by applying pressure or by heating and applying pressure with a roller or a heat roller fixing unit maintaining a constant temperature to form a duplicating image.

The fixing pressure in the fixing process to fix the toner image on the surface of the transfer-receiving material by applying pressure or by heating and applying pressure is preferably 0.5 to 30 MPa, more preferably 1 to 20 MPa, and still more preferably 1 to 10 MPa. When the numerical value is in the above range, sufficient fixation can be ensured and excellent image strength can be obtained. In addition, reduction of image quality characteristics due to paper wrinkle and paper stretching can be restrained.

In the fixing process, when fixation of an image is done by heating and applying pressure, the heating temperature is preferably 40 to 120° C., and more preferably 50 to 100° C.

It is preferred for the image-forming process of the exemplary embodiment to further include a cleaning process. The cleaning process is a process for removing the electrostatic image developing toner and electrostatic image developer remained on the surface of the electrostatic latent image holding member.

In the image-forming method of the exemplary embodiment, an embodiment of further including a recycling process is preferred. The recycling process is a process to convey the electrostatic image developing toner collected in the cleaning process to the developer layer. This image-forming method of the embodiment including the cleaning process can be carried out by a copier of a toner-recycling system type and an image-forming apparatus such as a facsimile. This method can also be applied to a recycling system of an embodiment of collecting a toner simultaneously with development by omitting a cleaning process.

V. Toner Cartridge and Process Cartridge

The toner cartridge in the exemplary embodiment is a toner cartridge holding at least the electrostatic image developing toner in the exemplary embodiment. The toner cartridge in the exemplary embodiment may contain the electrostatic image developing toner in the exemplary embodiment as an electrostatic image developer.

Further, the process cartridge in the exemplary embodiment is a process cartridge equipped with a developer holding member for holding the electrostatic image developing toner in the exemplary embodiment or the electrostatic image developer in the exemplary embodiment.

The toner cartridge in the exemplary embodiment is preferably attachable to and detachable from an image-forming apparatus. That is, in an image-forming apparatus having a constitution in which a toner cartridge is attachable and detachable, the toner cartridge in the exemplary embodiment housing the toner in the exemplary embodiment is preferably used.

The toner cartridge may be a cartridge for housing the toner and the carrier, alternatively the cartridge may be constituted separately as a cartridge for housing the toner alone and a cartridge for housing the carrier alone.

The process cartridge in the exemplary embodiment is preferably attachable to and detachable from the image-forming apparatus.

Further, the process cartridge in the exemplary embodiment is preferably a process cartridge equipped with at least one unit selected from the group consisting of an image holding member, a charging unit for charging the surface of the image holding member, and a cleaning unit for removing the toner remained on the surface of the image holding member. Further, the process cartridge in the exemplary embodiment may include other members such as a destaticizing unit and the like, if necessary.

Toner cartridges and process cartridges having known structures may be adopted and, for example, JP-A-2008-209489 and JP-A-2008-233736 can be referred to.

EXAMPLE

The invention will be described in further detail with reference to examples, but the examples by no means restrict the invention. In the examples "parts" means "weight parts" and "%" means "wt %" unless otherwise indicated.

In the following examples, a volume average particle size, a number average molecular weight, glass transition temperature (Tg), a melting point (mp), and flow tester viscosity are measured as follows.

<Measurement of Volume Average Particle Size of Particles>

In the measurement of the volume average particle size of particles, a Coulter Counter TA-II (manufactured by Beckmann-Coulter) is used. In this case, measurement is performed by using optimal apertures according to the particle size levels of particles. The measured particle size of the particle is expressed as volume average particle size (μm).

When the particle size of the particle is 5 μm or less, measurement is performed with a laser diffraction scattering system particle size distribution measuring instrument (LA-700, manufactured by Horiba, Ltd.).

<Number Average Molecular Weight>

A number average molecular weight is measured with gel permeation chromatography (HLC-8120GPC, TSK-GEL, GMH columns, manufactured by TOSOH CORPORATION) on the following condition. A solvent (tetrahydrofuran) is flown at a flow rate of 1.2 ml per minute at a temperature of 40° C., and measurement is carried out by pouring a tetrahydrofuran sample solution in concentration of 0.2 g/20 ml as a sample weight of 3 mg. In molecular weight measurement of the sample, measuring condition is selected so that the molecular weight of the sample is included in the range making a straight line in count number with the logarithms of the molecular weight of calibration curves produced by several kinds of monodispersed polystyrene standard samples.

<Glass Transition Temperature>

A glass transition temperature (Tg) is measured by the method prescribed in ASTM D3418-82 with a differential scanning calorimeter (DSDC) when measurement is performed from −80° C. to 150° C. at a temperature increasing rate of 10° C. every minute.

<Melting Point>

A melting point is found as a melting peak temperature of input compensation differential scanning calorimetry shown in JIS K-7121 when measurement is performed from room temperature (25° C.) to 150° C. at a temperature increasing rate of 10° C. every minute.

<Flow Tester Viscosity>

The flow tester viscosity of the block copolymer is found from the elution curve obtained from measurement of a cylindrical sample of diameter 1 cm×thickness 1 cm with a flow tester CFT-500C (die diameter: 0.5 mm, manufactured by Shimadzu Corporation) from room temperature to 200° C. at a temperature rising rate of 1° C. per minute.

<Volume Resistance>

The volume resistance (specific volume resistance) of the block copolymer is measured according to the method of ASTM D257 with an insulation meter R503 and a measuring electrode R616 (manufactured by Kawaguchi Electric Works Co., Ltd.).

<Synthesis of 2-methyl-2-[N-(tert-butyl)-N-(1-diethoxyphosphoryl-2,2-dimethyl-propyl)-aminoxy]-propionic acid (MBPAP)>

Into a nitrogen-purged glass vessel are introduced 500 parts of degassed toluene, 35.9 parts of CuBr, 15.9 parts of copper powder, and 86.7 parts of N,N,N',N',N"-pentamethyldiethylenetriamine, and while stirring, 580 parts of degassed toluene, 42.1 parts of 2-bromo-2-methylpropionic acid, and 78.9 parts of N-tert-butyl-N-(1-diethylphosphono-2,2-dimethylpropyl)nitroxide are introduced and stirred for 90 minutes at room temperature. After that, the reaction medium is filtered, and further, toluene filtrate is washed with an $NH_4Cl$ saturated aqueous solution two times. The obtained solid is washed with pentane and vacuum dried to obtain 2-methyl-2-[N-(tert-butyl)-N-(1-diethoxyphosphoryl-2,2-dimethylpropyl)-aminoxy]-propionic acid (MBPAP).

The molar mass of the prepared MBPAP found by mass spectrometry is 381.44 g/mol ($C_{17}H_{36}NO_6P$), which is confirmed to be an objective product.

<Preparation of Releasing Agent Particle Dispersion>

| | |
|---|---|
| Ester wax (WE-2, melting point: 65° C., manufactured by NOF Corporation) | 50 parts |
| Anionic surfactant (Neogen RK, manufactured by DAI-ICHI KOGYO SEIYAKU CO., LTD.) | 5 parts |
| Ion exchange water | 200 parts |

The above components are mixed, heated at 95° C., and dispersed with a homogenizer (ULTRA-TURRAX T50, manufactured by IKA), and then subjected to dispersion treatment with a Manton Gaulin high pressure homogenizer (manufactured by Manton Gaulin) to obtain releasing agent dispersion having dispersed therein a releasing agent (concentration of the releasing agent: 20 wt %) having an average particle size of 230 nm.

<Preparation of Coloring Agent Particle Dispersion>

| | |
|---|---|
| Cyan pigment (Pigment Blue 15:3 (copper phthalocyanine), manufactured by Dainichiseika Color & Chemicals Mfg. Co., Ltd.) | 1,000 parts |

-continued

| | |
|---|---|
| Anionic surfactant (Neogen R, manufactured by DAI-ICHI KOGYO SEIYAKU CO., LTD.) | 150 parts |
| Ion exchange water | 9,000 parts |

The above components are mixed and dissolved, and then dispersed with a high pressure impact type disperser Altimizer (HJP30006, manufactured by Sugino Machine Limited) for about 1 hour to prepare a coloring agent particle dispersion having dispersed therein a coloring agent (a cyan pigment). The average particle size of the coloring agents (cyan pigment) in the coloring agent particle dispersion is 0.15 μm, the concentration of the coloring agent particles is 23 wt %.

Example 1

<Preparation of Block Copolymer (1)>

Into a glass vessel equipped with a reflux condenser, nitrogen introducing pipe and a stirrer are put 200 parts of a styrene monomer and 2.7 parts of MBPAP and thoroughly mixed under nitrogen current at 80° C., and then the temperature is raised to 110° C. to polymerize styrene. The molecular weight is measured by GPC from time to time, and the rate of polymerization (invert ratio) found from the residual amount of styrene measured by a weight loss method when the number average molecular weight of styrene reaches 28,000 is 99.5%.

After that, 221 parts of stearyl acrylate is added and polymerization is continued at 130° C. for extension of the polymer chain by stearyl acrylate. The number average molecular weight of crystalline block B derived from stearyl acrylate is 31,000, and at the time when the number average molecular weight in total with the initially polymerized styrene chain reaches 59,000, the reaction system is cooled to room temperature.

The polymerized substance is dissolved in 225 parts of THF and taken out and dripped into methanol to re-precipitate block copolymer (1). The precipitate is collected by filtration and washed with methanol repeatedly, followed by vacuum drying at 40° C. to obtain bock copolymer (1) of styrene and stearyl acrylate.

A styrene homopolymer having a number average molecular weight of 28,000 prepared with the same polymerization apparatus by using 50 parts of styrene and 0.68 parts of MBPAP in the same manner has a glass transition temperature (Tg) of 100° C. on measurement after the same refining.

A homopolymer having a number average molecular weight of 31,000 polymerized in the same manner by using 300 parts of stearyl acrylate and 3.7 parts of MBPAP has Tg of −75° C. and a melting point (mp) of 45° C. after refining.

The temperature making the flow tester viscosity of the obtained block copolymer (1) $10^4$ Pa·s is 110° C. (T(0.5 MPa)) at 0.5 MPa, 55° C. (T(30 MPa)) at 30 MPa, and T(0.5 MPa)−T(30 MPa) is 55° C. The volume resistance of the block copolymer is $1\times10^{14.3}$ Ωcm.

<Preparation of Resin Particle Dispersion (1)>

To 400 parts of block copolymer (1) is added 120 parts of methyl ethyl ketone containing 8.0 parts of sorbitan sesquiolate and 0.8 parts of sodium dodecylbenzenesulfonate having been dissolved therein. The above mixture is put in a glass vessel equipped with a reflux condenser, a stirrer, an ion exchange water dripper, and a heating unit and thoroughly mixed at 65° C., followed by heating and mixing at 65° C. for 1 hour. After that, 1,000 parts of ion exchange water is dripped to the above mixture at a rate of 1 part/min to perform phase inversion emulsification of block copolymer (1). The phase inversion emulsified product is cooled, and MEK is removed from the emulsified liquid with an evaporator at 60° C. under reduced pressure to obtain resin particle dispersion (1).

The volume average particle size of the resin particles in the obtained resin particle dispersion is 205 nm, and the solid content concentration is 2.5 wt %.

<Preparation of Toner Particles (1)>

| | |
|---|---|
| Resin particle dispersion (1) | 565 parts (solid content: 240 parts) |
| Coloring agent particle dispersion | 22.87 parts (solid content: 5.3 parts) |
| Releasing agent particle dispersion | 50 parts (solid content: 10 parts) |

The above raw materials are put in a cylindrical stainless steel vessel exclusive of 158 parts (solid content: 67 parts) of resin particle dispersion (1), and dispersed and mixed for 30 minutes by means of an ULTRA-TURRAX with applying shear force at 8,000 rpm. Subsequently, 0.14 parts of a 10% nitric acid aqueous solution containing aluminum polychloride as the aggregating agent is dripped thereto. The pH of the raw material dispersion is controlled in the range of 4.2 to 4.5 at this time. The pH is adjusted with 0.3N nitric acid and 1N sodium hydroxide aqueous solution according to necessity. After that, the raw material dispersion is shifted to a kettle equipped with a stirrer and a thermometer and heated. The growth of the aggregated particles is accelerated at 40° C. At the time when the volume average particle size is 5.0 μm, 158 parts of resin particle dispersion (1) that has been divided not for use is gradually added, and the temperature is raised up to 50° C. to grow the particle size to 6.1 μm. After the pH is further raised to 7.5, the temperature is raised to 98° C. and maintained for 6 hours at 98° C., and then the pH is gradually lowered to 6.5, heating is stopped, and the particles are allowed to stand to be cooled. The particles are filtered through a filter having a pore diameter of 45 μm. After repeating washing with water, the reaction product is freeze dried to obtain toner particles (1).

As a result of measurement of the volume average particle size of toner particles (1) with a Coulter Multisizer TA-II type (aperture diameter: 50 μm, manufactured by Beckmann Coulter, Inc.), the particle size is 6.1 μm and the volume average particle size distribution is 1.22.

<Preparation of Electrostatic Image Developing Toner (1) and Electrostatic Image Developer (1)>

To 100 parts of toner particles (1) is externally added 1 part of colloidal silica (AEROSIL R972, manufactured by Nippon Aerosil Co., Ltd.) and mixed with a Henschel mixer to obtain electrostatic image developing toner (1).

On the other hand, 100 parts of ferrite particles (EFC50B, average particle size: 50 μm, manufactured by Powder Tech Co., Ltd.) and 1 part of a methacrylate resin (molecular weight: 95,000, manufactured by Mitsubishi Rayon Co., Ltd.) are put in a pressure kneader with 500 parts of toluene, mixed at ordinary temperature for 15 minutes, the temperature is raised to 70° C. while mixing under reduced pressure to distill off the toluene, followed by cooling, and filtering with a filter having a pore diameter of 105 μm for sizing to manufacture ferrite carrier (resin-covered carrier).

The ferrite carrier and electrostatic image developing toner (1) are mixed to prepare two-component electrostatic image developer (1) having toner concentration of 7 wt %.

<Evaluation of Electrostatic Image Developing Toner and Electrostatic Image Developer>

As image-forming apparatus, a modifier of Docu Centre Color f 450 (a product of Fuji Xerox Co., Ltd.) is used. As for the fixing unit, a two-roll type fixing unit capable of adjusting the maximum fixing pressure is modified and, further, the pressure roll on the image side is modified to a high hard roll by coating Teflon (trademark) on a SUS pipe. As the transfer-receiving paper, Fuji Xerox S Paper is used.

Splashing of toner, staining in the apparatus, toner strength in the system, fixing property, and fixed image strength are evaluated as follows. The results of evaluations are shown in Table 1 below.

<Evaluation of Splashing of Toner (Intermittent Mode)>

Printing test of 1,000 sheets in total is performed with the modified apparatus, the above electrostatic image developing toner and the electrostatic image developer according to the intermittent mode of repeating printing of 100 sheets and intermission of 1 hour.

Each of the first images printed immediately after intermission of 1 hour is evaluated for splashing of toner (intermittent mode). The results are shown in Table 1. Evaluation is performed by visual observation. The criteria of the evaluations are as follows.

A: In each of the first images after intermission, an image defect such as a black spot or the like does not occur.

B: In any one or more of the first images after intermission, image defects such as black spots occur in several places.

C: In each of the first images after intermission, image defects such as black spots occur in many places, <Evaluation of Staining in the Apparatus (Intermittent Mode)>

Printing test of 1,000 sheets in total is performed with the modified apparatus, the above electrostatic image developing toner and the electrostatic image developer according to the intermittent mode of repeating printing of 100 sheets and intermission of 1 hour.

The staining in the apparatus after printing 1,000 sheets is evaluated. The results are shown in Table 1. Evaluation is performed by visual observing the inside of the modified apparatus immediately after printing. The criteria of the evaluations are as follows.

A: Staining in the apparatus does not occur, and an image defect such as a black spot or the like does not occur on the $1,000^{th}$ image.

B: Although staining in the apparatus occurs, an image defect such as a black spot or the like does not occur on the $1,000^{th}$ image and on a practicable level.

C: Staining in the apparatus occurs, and image defects such as black spots due to staining in the apparatus occur on the $1,000^{th}$ image.

<Evaluation of Toner Strength in the System>

For the evaluation of toner strength in the system, after continuously printing 5,000 sheets with the modified apparatus, the above electrostatic image developing toner and the electrostatic image developer at image density of 5%, presences of crushing, breaking, and aggregation of the toner in the developing apparatus are visually confirmed. The criteria of the evaluations are as follows.

A: Crushing, breaking, and aggregation of the toner are not observed, and on a level free from a problem.

B: Crushing, breaking, and aggregation of the toner are observed a little, but on a practicable level.

C: Crushing, breaking, and aggregation of the toner are conspicuous and practicably on a level of great problems.

<Evaluation of Fixing Property>

After heating the fixing roll of the fixing apparatus at 60° C. and setting the fixing pressure at 1 MPa, 5 MPa or 10 MPa, an image is fixed at each fixing pressure and fixing property is evaluated. The criteria of the evaluations are as follows. The results obtained are shown in Table 1.

A: The image is free from unevenness (gloss is also free from unevenness) and adhesion with the paper is also good.

B: Although slight image unevenness is observed, adhesion with the paper is good and on a practicable level.

C: Image unevenness is caused and adhesion with the paper is on a level practicably having a problem.

<Fixed Image Strength>

Scratching test with a pencil is performed on an image part after fixation by fixing pressure of 1 MPa on the basis of JIS K5400, and judged by the pencil hardness as follows. The results obtained are shown in Table 1.

A: On a level of no problem at all by pencil hardness of H or more.

B: On a level of practicably no problem by pencil hardness of HB or more.

C: On a level practicably having a problem by pencil hardness of less than HB.

Example 2

<Preparation of Block Copolymer (2)>

Block copolymer (2) having block A and crystalline block B as shown in Table 1 is prepared in the same manner as in Example 1 except for using 200 parts of a styrene monomer, 2.3 parts of MBPAP, and 259 parts of behenyl acrylate in place of 200 parts of styrene monomer, 2.7 parts of MBPAP, and 221 parts of stearyl acrylate.

<Preparation of Resin Particle Dispersion (2)>

Resin particle dispersion (2) is prepared by using block copolymer (2) and performing emulsification in the same manner as in Example 1. The volume average particle size of the resin particles in resin particle dispersion (2) is 198 nm, and solid content concentration is 42.5%.

<Preparation of Toner Particles (2)>

Toner particles (2) are prepared by using resin particle dispersion (2) in the same manner as in Example 1. As a result of measurement of the volume average particle size of toner particles (2), the particle size is 6.2 μm, and the volume average particle size distribution is 1.21.

<Preparation and Evaluation of Electrostatic Image Developing Toner (2) and Electrostatic Image Developer (2)>

Electrostatic image developing toner (2) and electrostatic image developer (2) are prepared by using toner particles (2) in the same manner as in Example 1, and evaluations are performed in the same manner as in Example 1. The results obtained are shown in Table 1.

Example 3

<Preparation of Block Copolymer (3)>

Block copolymer (3) having block A and crystalline block B as shown in Table 1 is prepared in the same manner as in Example 1 except for using 200 parts of a styrene monomer, 2.7 parts of MBPAP, and 205.3 parts of cetyl acrylate in place of 200 parts of styrene monomer, 2.7 parts of MBPAP, and 221 parts of stearyl acrylate.

<Preparation of Resin Particle Dispersion (3)>

Resin particle dispersion (3) is prepared by using block copolymer (3) and performing emulsification in the same manner as in Example 1. The volume average particle size of the resin particles in the resin particle dispersion is 199 nm, and solid content concentration is 42.5%.

<Preparation of Toner Particles (3)>

Toner particles (3) are prepared by using resin particle dispersion (3) in the same manner as in Example 1. As a result of measurement of the volume average particle size of toner particles (3), the particle size is 6.1 μm, and the volume average particle size distribution is 1.21.

<Preparation and Evaluation of Electrostatic Image Developing Toner (3) and Electrostatic Image Developer (3)>

Electrostatic image developing toner (3) and electrostatic image developer (3) are prepared by using toner particles (3) in the same manner as in Example 1, and evaluations are performed in the same manner as in Example 1. The results obtained are shown in Table 1.

Comparative Example 1

<Preparation of Styrene/Butyl Acrylate/Acrylic Acid Random Polymer Resin Particle Dispersion (C1)>

In a reactor equipped with a reflux condenser, a stirrer, a nitrogen-introducing pipe, and a monomer dripping funnel, 3.3 parts of sodium dodecylbenzenesulfonate is dissolved in 3,824 parts of ion exchange water. Subsequently, 30.6 parts of styrene, 9.4 parts of butyl acrylate, 1.2 parts of acrylic acid dimer, and 0.3 parts of dodecanethiol are added thereto, and thoroughly stirred at room temperature for emulsification stabilization (emulsified liquid 1).

Further, 1,327 parts of ion exchange water having dissolved therein 3,000 parts of styrene, 940 parts of butyl acrylate, 120 parts of acrylic acid dimer, 63 parts of dodecanethiol, and 39 parts of sodium dodecylbenzenesulfonate is put in a vessel with a stirrer, and the mixture is separately emulsified with a homomixer. After emulsification, the emulsified product is continuously gently stirred with the stirrer having four inclined paddles (emulsified liquid 2).

After sufficiently substituting nitrogen in the emulsified liquid 1, emulsified liquid 1 is heated up to 75° C. while further introducing nitrogen, 600 parts of a 10% ammonium persulfate aqueous solution is added and heating is continued for 10 minutes. Emulsified liquid 2 is gradually dripped with a pump from the monomer dripping funnel of the reactor of emulsified liquid 1 over 3 hours, and the reaction at 75° C. is continued. After termination of dripping of emulsified liquid 2, the reaction at 75° C. is continued for further 3 hours, and then the reaction product is cooled to obtain resin particle dispersion (C1) having a particle size of 200 nm and solid content concentration of 42.5%. The number average molecular weight of the dispersion is 11,000 and Tg is 52° C. by measurement after drying.

<Preparation of Toner Particles (C1)>

Toner particles (C1) are prepared in the same manner as in Example 1 except for using resin particle dispersion (C1) in place of resin particle dispersion (1) manufactured in Example 1.

The volume average particle size of toner particles (C1) is 6.0 μm, and the volume average particle size distribution is 1.21.

<Preparation and Evaluation of Electrostatic Image Developing Toner (C1) and Electrostatic Image Developer (C1)>

Electrostatic image developing toner (C1) and electrostatic image developer (C1) are manufactured in the same manner as in Example 1 with toner particles (C1), and evaluated in the same manner as in Example 1. The results obtained are shown in Table 1.

Comparative Example 2

<Preparation of Block Copolymer Resin (C2)>

Block copolymer (C2) having block A and a block derived from a butyl acrylate polymer shown in Table 1 is prepared in the same manner as in Example 1 except for using 200 parts of a styrene monomer, 18.8 parts of MBPAP, and 205 parts of butyl acrylate in place of 200 parts of styrene monomer, 2.7 parts of MBPAP, and 221 parts of stearyl acrylate.

<Preparation of Resin Particle Dispersion (C2)>

Resin particle dispersion (C2) is prepared with block copolymer resin (C2) by performing emulsification in the same manner as in Example 1. The volume average particle size of the resin particles in the resin particle dispersion is 189 nm, and solid content concentration is 42.5%.

<Preparation of Toner Particles (C2)>

Toner particles (C2) are prepared in the same manner as in Example 1 with resin particle dispersion (C2). As a result of measurement of the volume average particle size of toner particles (C2), the particle size is 6.0 μm, and the volume average particle size distribution is 1.21.

<Preparation and Evaluation of Electrostatic Image Developing Toner (C2) and Electrostatic Image Developer (C2)>

Electrostatic image developing toner (C2) and electrostatic image developer (C2) are prepared by using toner particles (C2) in the same manner as in Example 1, and evaluations are performed in the same manner as in Example 1. The results obtained are shown in Table 1.

Comparative Example 3

<Preparation of Block Copolymer Resin (C3)>

Block copolymer (C3) having block A and a block derived from a butyl acrylate polymer shown in Table 1 is prepared in the same manner as in Example 1 except for using 200 parts of a styrene monomer, 0.88 parts of MBPAP, and 220 parts of butyl acrylate in place of 200 parts of styrene monomer, 2.7 parts of MBPAP, and 221 parts of stearyl acrylate.

<Preparation of Resin Particle Dispersion (C3)>

Resin particle dispersion (C3) is prepared with block copolymer resin (C3) by performing emulsification in the same manner as in Example 1. The volume average particle size of the resin particles in the resin particle dispersion is 268 nm, and solid content concentration is 42.5%.

<Preparation of Toner Particles (C3)>

Toner particles (C3) are prepared in the same manner as in Example 1 with resin particle dispersion (C3). As a result of measurement of the volume average particle size of toner particles (C3), the particle size is 6.4 μm, and the volume average particle size distribution is 1.21.

<Preparation and Evaluation of Electrostatic Image Developing Toner (C3) and Electrostatic Image Developer (C3)>

Electrostatic image developing toner (C3) and electrostatic image developer (C3) are prepared by using toner particles (C3) in the same manner as in Example 1, and evaluations are performed in the same manner as in Example 1. The results obtained are shown in Table 1.

Comparative Example 4

<Preparation of Block Copolymer Resin (C4)>

Block copolymer (C4) having block A and crystalline block B shown in Table 1 is prepared in the same manner as in Example 1 except for using 200 parts of a styrene monomer, 13.6 parts of MBPAP, and 193 parts of butyl methacrylate in place of 200 parts of styrene monomer, 2.7 parts of MBPAP, and 221 parts of stearyl acrylate.

<Preparation of Resin Particle Dispersion (C4)>

Resin particle dispersion (C4) is prepared with block copolymer resin (C4) by performing emulsification in the same manner as in Example 1. The volume average particle size of the resin particles in the resin particle dispersion is 288 nm, and solid content concentration is 42.5%.

<Preparation of Toner Particles (C4)>

Toner particles (C4) are prepared in the same manner as in Example 1 with resin particle dispersion (C4). As a result of measurement of the volume average particle size of toner particles (C4), the particle size is 6.5 μm, and the volume average particle size distribution is 1.21.

<Preparation and Evaluation of Electrostatic Image Developing Toner (C4) and Electrostatic Image Developer (C4)>

Electrostatic image developing toner (C4) and electrostatic image developer (C4) are prepared by using toner particles (C4) in the same manner as in Example 1, and evaluations are performed in the same manner as in Example 1. The results obtained are shown in Table 1.

Comparative Example 5

<Preparation of Block Copolymer Resin (C5)>

Block copolymer (C5) having block A and crystalline block B shown in Table 1 is prepared in the same manner as in Example 1 except for using 198 parts of lauryl acrylate in place of 221 parts of stearyl acrylate.

<Preparation of Resin Particle Dispersion (C5)>

Resin particle dispersion (C5) is prepared with block copolymer resin (C5) by performing emulsification in the same manner as in Example 1. The volume average particle size of the resin particles in the resin particle dispersion is 288 nm, and solid content concentration is 42.5%.

<Preparation of Toner Particles (C5)>

Toner particles (C5) are prepared in the same manner as in Example 1 with resin particle dispersion (C5). As a result of measurement of the volume average particle size of toner particles (C5), the particle size is 6.5 μm, and the volume average particle size distribution is 1.21.

<Preparation and Evaluation of Electrostatic Image Developing Toner (C5) and Electrostatic Image Developer (C5)>

Electrostatic image developing toner (C5) and electrostatic image developer (C5) are prepared by using toner particles (C5) in the same manner as in Example 1, and evaluations are performed in the same manner as in Example 1. The results obtained are shown in Table 1.

TABLE 1

| | | Example No. | | |
|---|---|---|---|---|
| | | Example 1 | Example 2 | Example 3 |
| | Block Copolymer | (1) | (2) | (3) |
| Block A | Ethylenically unsaturated compound | Styrene | Styrene | Styrene |
| | Glass transition temperature (Tg) (A) (° C.) | 100 | 100 | 100 |
| | Number average molecular weight | 28,000 | 33,000 | 29,000 |

TABLE 1-continued

| | | | | |
|---|---|---|---|---|
| Crystalline Block B | Ethylenically unsaturated compound | Stearyl acrylate | Behenyl acrylate | Cetyl acrylate |
| | Glass transition temperature (Tg) (B) (° C.) | −75 | 10 | 20 |
| | Melting point (mp) (° C.) | 45 | 65 | 43 |
| | Number average molecular weight | 31,000 | 30,000 | 29,000 |
| Block Copolymer | Number average molecular weight | 59,000 | 63,000 | 58,000 |
| | Tg (A) − (Tg) (B) (° C.) | 175 | 90 | 80 |
| | T(0.5 MPa) (° C.) | 110 | 115 | 113 |
| | T(30 MPa) (° C.) | 55 | 50 | 60 |
| | T(0.5 MPa) − T(30 MPa) (° C.) | 55 | 65 | 53 |
| | Crystalline block B molar fraction (mol %) | 26 | 26 | 27 |
| | Crystalline block B weight fraction (wt %) | 53 | 56 | 50 |
| | Volume resistance of resin (Log Ωcm) | 14.3 | 14.7 | 14.1 |
| Results of Evaluation | Toner splashing | A | A | A |
| | Staining in the apparatus | A | A | A |
| | Toner strength | A | A | A |
| | Fixing property (1 MPa) | A | A | A |
| | Fixing property (5 MPa) | A | A | A |
| | Fixing property (10 MPa) | A | A | A |
| | Fixed image strength | A | A | A |

| | | Comparative Example No. | | | | |
|---|---|---|---|---|---|---|
| | | Comp. Ex. 1 | Comp. Ex. 2 | Comp. Ex. 3 | Comp. Ex. 4 | Comp. Ex. 5 |
| | Block Copolymer | (C1) | (C2) | (C3) | (C4) | (C5) |
| Block A | Ethylenically unsaturated compound | Styrene | Styrene | Styrene | Styrene | Styrene |
| | Glass transition temperature (Tg) (A) (° C.) | 52 | 75 | 100 | 78 | 100 |
| | Number average molecular weight | 11,000 | 4,050 | 87,000 | 5,600 | 28,000 |
| Crystalline Block B | Ethylenically unsaturated compound | Butyl acrylate | Butyl acrylate | Butyl acrylate | Butyl methacrylate | Lauryl acrylate |
| | Glass transition temperature (Tg) (B) (° C.) | 52 | −35 | −35 | 23 | −50 |
| | Melting point (mp) (° C.) | None | None | None | None | 10 |
| | Number average molecular weight | 11,000 | 4,150 | 95,000 | 5,400 | 28,000 |
| Block Copolymer | Number average molecular weight | 11,000 | 8,200 | 182,000 | 11,000 | 56,000 |
| | Tg (A) − (Tg) (B) (° C.) | — | 110 | 135 | 55 | 150 |
| | T(0.5 MPa) (° C.) | 142 | 58 | 173 | ≧200 | 121 |
| | T(30 MPa) (° C.) | 140 | 45 | 83 | ≧200 | 60 |
| | T(0.5 MPa) − T(30 MPa) (° C.) | 2 | 13 | 90 | — | 61 |
| | Crystalline block B molar fraction (mol %) | — | 45 | 47 | 44 | 30 |
| | Crystalline block B weight fraction (wt %) | — | 51 | 52 | 49 | 50 |
| | Volume resistance of resin (Log Ωcm) | 14.8 | 12.5 | 13.2 | 12.9 | 13.4 |
| Results of Evaluation | Toner splashing | A | B | B | B | B |
| | Staining in the apparatus | A | B | B | C | C |
| | Toner strength | A | C | A | C | A |
| | Fixing property (1 MPa) | C | A | C | C | A |
| | Fixing property (5 MPa) | C | A | C | C | A |
| | Fixing property (10 MPa) | C | A | C | C | A |
| | Fixed image strength | C | C | C | C | B |

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An electrostatic image developing toner, comprising:

a block copolymer that contains:

a block A that has a glass transition temperature of about 60° C. or more; and a crystalline block B that has a melting point of about 25° C. or more derived from an ethylenically unsaturated compound, wherein a molar fraction of a monomer unit constituting the crystalline block B is about 15 to about 35 mol % based on the entire monomer units constituting the block copolymer, and wherein the block copolymer satisfies the following equations (1) to (3):

$$30° \text{ C.} \leqq [T(0.5 \text{ MPa}) - T(30 \text{ MPa})] \leqq 80° \text{ C.} \quad (1)$$

$$60° \text{ C.} \leqq T(0.5 \text{ MPa}) \quad (2)$$

$$T(30 \text{ MPa}) \leqq 80° \text{ C.} \quad (3)$$

where:

T(0.5 MPa) represents a temperature at which a viscosity of the block copolymer is $10^4$ Pa·s when a pressure applied by a flow tester is 0.5 MPa; and T(30 MPa) represents a temperature at which a viscosity of the block copolymer is $10^4$ Pa·s when a pressure applied by a flow tester is 30 MPa.

2. The electrostatic image developing toner according to claim 1, wherein the crystalline block B has the melting point of about 40 to about 100° C.

3. The electrostatic image developing toner according to claim 1, wherein the crystalline block B has a glass transition temperature of about 20° C. or less.

4. The electrostatic image developing toner according to claim 1, wherein Tg (A)-Tg (B) is about 60° C. or more, in which Tg (A) represents a glass transition temperature of the block A and Tg (B) represents a glass transition temperature of the crystalline block B.

5. The electrostatic image developing toner according to claim 1, wherein a monomer unit derived from the ethylenically unsaturated compound has a side chain having a larger carbon number than carbon atom number of 12.

6. The electrostatic image developing toner according to claim 1, wherein a weight fraction of the crystalline block B in the block copolymer is about 40 to about 65 wt %.

7. The electrostatic image developing toner according to claim 1, wherein the block copolymer has a number average molecular weight of about 10,000 to about 150,000.

8. The electrostatic image developing toner according to claim 1, wherein each of the block A and the crystalline block B has a number average molecular weight of about 5,000 to about 100,000.

9. The electrostatic image developing toner according to claim 1, wherein the block A is a polymer derived from at least one of styrene and derivatives thereof.

10. The electrostatic image developing toner according to claim 1, wherein the block copolymer is synthesized by living radical polymerization.

11. The electrostatic image developing toner according to claim 1, wherein the block copolymer has a volume resistance (specific volume resistance) of about $1\times10^{13}$ to about $1\times10^{16}$ Ωcm.

12. The electrostatic image developing toner according to claim 1, which has a volume average particle size ($D_{50v}$) of about 2 to about 10 μm.

13. The electrostatic image developing toner according to claim 1, which has a number average particle size distribution index ($GSD_p$) calculated as $(D_{84p}/D_{16p})^{1/2}$ of about 1.40 or less, in which $D_{16p}$ and $D_{84p}$ represent a 16% particle size and a 84% particle size from the smaller particle size side in terms of number average particle size of the toner, respectively.

14. The electrostatic image developing toner according to claim 1, which has a quantity of charge of about 10 to about 40 μC/g as an absolute value.

15. A method for manufacturing the electrostatic image developing toner according to claim 1, the method comprising:

dispersing the block copolymer in an aqueous medium so as to manufacture a resin particle dispersion containing the block copolymer;

aggregating dispersed resin particles to obtain aggregated particles; and fusing the aggregated particles by heating.

16. The manufacturing method according to claim 15, wherein the dispersing contains an emulsifying process by mini-emulsion polymerization.

17. An electrostatic image developer, comprising:

the electrostatic image developing toner according to claim 1; and a carrier.

18. The electrostatic image developer according to claim 17, wherein the carrier is a resin-covered carrier.

* * * * *